US007740549B2

(12) United States Patent
Alekseev

(10) Patent No.: US 7,740,549 B2
(45) Date of Patent: Jun. 22, 2010

(54) DEVICE FOR TRAINING AND IMPROVING A VOLLEYBALL SPIKE TECHNIQUE

(76) Inventor: Aleksandr Leonidovich Alekseev, ul. Michurina, 54, Balakovo, Saratovskaya obl. (RU) 413800

( * ) Notice: Subject to any disclaimer, the term of this patent is extended or adjusted under 35 U.S.C. 154(b) by 169 days.

(21) Appl. No.: 12/084,590

(22) PCT Filed: Jan. 16, 2006

(86) PCT No.: PCT/RU2006/000010

§ 371 (c)(1),
(2), (4) Date: May 6, 2008

(87) PCT Pub. No.: WO2007/053054

PCT Pub. Date: May 10, 2007

(65) Prior Publication Data

US 2009/0137349 A1 May 28, 2009

(30) Foreign Application Priority Data

Nov. 7, 2005 (RU) ..... 2005134026

(51) Int. Cl.
*A63B 69/00* (2006.01)

(52) U.S. Cl. ..... 473/459

(58) Field of Classification Search ..... 473/423, 473/430, 436, 459

See application file for complete search history.

(56) References Cited

U.S. PATENT DOCUMENTS 4,204,678 A * 5/1980 Weis ..... 473/423
4,881,742 A * 11/1989 Hargreave ..... 473/575
4,948,150 A * 8/1990 Daly et al. ..... 473/430
5,435,572 A * 7/1995 Covel ..... 473/423
5,624,113 A * 4/1997 Rabine ..... 473/430
5,755,631 A * 5/1998 Paschka ..... 473/459
5,792,014 A * 8/1998 Brown ..... 473/430
5,913,739 A * 6/1999 Brenneisen ..... 473/430
5,957,781 A * 9/1999 Kelly ..... 473/140
6,672,979 B2 * 1/2004 Brenneisen ..... 473/430
7,041,016 B1 * 5/2006 Omtvedt ..... 473/426
7,070,520 B1 * 7/2006 An ..... 473/422
7,445,568 B1 * 11/2008 Steffensmeier ..... 473/430

(Continued)

FOREIGN PATENT DOCUMENTS

JP 2003-052879 2/2003

(Continued)

*Primary Examiner*—Raleigh W. Chiu
(74) *Attorney, Agent, or Firm*—Aleksandr Smushkovich

(57) ABSTRACT

The invention relates to sports training devices and can be used for training a volleyball spike-motion. The inventive device comprises a bearing frame, a ball, and a unit for returning the ball to the initial position thereof, which unit is provided with an elastic stretching connected to the frame by one end thereof, a rod whose one end is fixed to the frame in such a way that it has at least two degrees of freedom, whereas the second end of the rod is connected to the ball, and the second end of the stretching is connected to the rod. The frame is also provided with a limiter of traveling the rod. The device enables the ball to be moved along an arc, thereby increasing the quality of the spike-motion training, and improves effectiveness and safety of the training.

9 Claims, 1 Drawing Sheet

U.S. PATENT DOCUMENTS

| | | | | |
|---|---|---|---|---|
| 2001/0003106 | A1* | 6/2001 | Brenneisen | 473/430 |
| 2005/0037874 | A1* | 2/2005 | McCoy | 473/430 |
| 2007/0049426 | A1* | 3/2007 | Huang | 473/417 |
| 2009/0137349 | A1* | 5/2009 | Alekseev | 473/436 |

FOREIGN PATENT DOCUMENTS

| | | |
|---|---|---|
| SU | 641973 | 1/1979 |
| SU | 1377127 | 2/1988 |
| SU | 1447385 | 12/1988 |

* cited by examiner

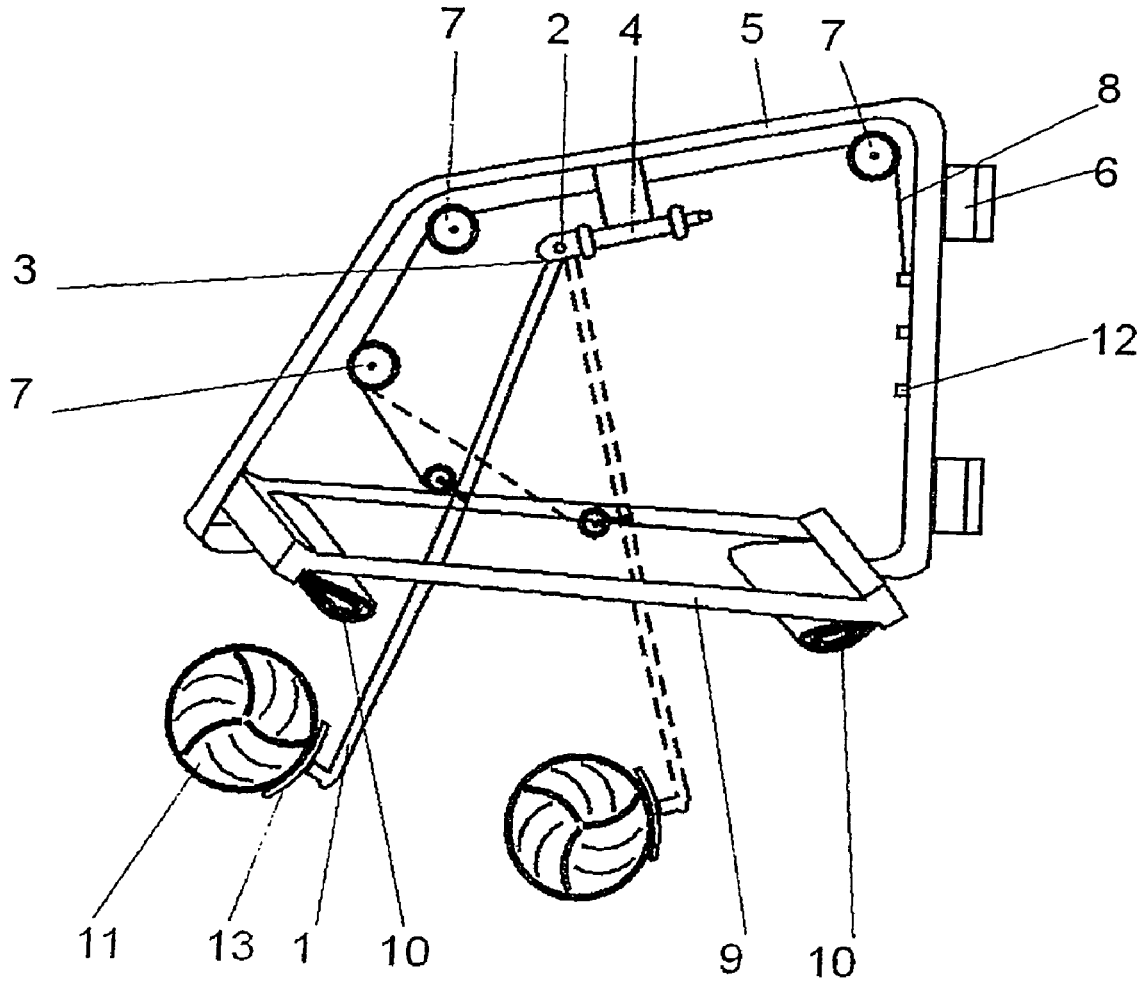
7
2
4
5
7
8
6
3
12
7
11
13
1
10
9
10

DEVICE FOR TRAINING AND IMPROVING A VOLLEYBALL SPIKE TECHNIQUE

CROSS-REFERENCE TO RELATED APPLICATIONS

This application is a U.S. national phase application of a PCT application PCT/RU2006/000010 filed on 16 Jan. 2006, published as WO2007/053054, whose disclosure is incorporated herein in its entirety by reference, which PCT application claims priority of a Russian patent application RU2005/134026 filed on 7 Nov. 2005.

TECHNOLOGY FIELD

The invention relates to sports-training devices of a striking type (also known in volleyball as 'spiking'), preferably intended for training and mastering the spike technique motion in volleyball, particularly, the technique of secondary spikes and development the ability to vary spike motions, namely spikes with a pass.

PRIOR ART BACKGROUND

There is known a device for training ball strikes, comprising an elastic belt with attachment elements. The belt has a carbine and a slide for engagement with an immovable support (see U.S. Pat. No. 4,325,548, IPC A63B69/00, published 20 Apr. 1982). However, the device has a long period of after-hit swings, and also does not allow the volleyball players to control correctness of operation of the player's hand.

There is known a device for training strike movements, comprising a slide incorporated in a casing, a springed pressing plate for contacting with the slide situated in a longitudinal slot of the casing and furnished with a mechanism regulating the pressure force and mounted outside the casing, an element for reverse of the pressing plate into the initial position, a rod, an elastic element situated around the rod, the rod having limit holes for fixing a predetermined length of the elastic element; the casing is so designed that is capable of displacing along the axis of the rod, the plate is so designed that is capable of turning in the longitudinal slot of the casing and reciprocal-progressive movement along the axis, perpendicularly to the axis of the casing; the device is distinct in relation to known devices in that it is furnished with a unit for reverse of the rod into the initial position, which unit is joined with a flexible puller having a first end of the rod and a second end thereof, wherein the second rod is joined with a carbine via a flexible puller, the contact portion of the pressing plate is made in a rounded shape to provide a pointed engagement surface with the slide, the slide is designed as a sphere with an inner hole for the rod and providing fixation of the sphere on the rod, having a fixing element in the initial position, wherein the casing is made immovable. The aforesaid device for training the striking motions is supplied with an imitator of a sporting implement for indication of the place of strike with a possibility of its return into the initial position (see Russian Federation Patent No. 2224565, IPC A63B69/00).

However, the reciprocal-progressive mechanism of the above-mentioned device provides a movement of the ball along the straight line, whereas the player's hand is moving along an arc. During the striking movement of the palm part of the hand at the ball, the ball and the hand are being in contact at a distance of 25-35 cm. This period is called "co-striking". Different trajectories of the ball and the hand lead to non-correspondence of the bio-mechanical conditions of the "co-striking" that is reflected in the quality of training. Also, the aforementioned device is insufficiently effective for practicing the strike techniques because of the limitations of degree of free movement, which limitations cause high demands to precision of the strike motion performance. This is unacceptable for training novice sportsmen, who have not acquired a movement reflex of striking motion.

The most close to the proposed solution is a device for training of tennis players, including a support with a bracket with a horizontal axis secured thereon and having a clamp. A bracket-shaped frame is disposed therein, supplied with elastic stretch elements with a ball secured thereon. The bracket is mounted on a pole, the frame is mounted on the axis at a predetermined angle to the horizon. The elastic stretch elements provide the role of a reverse mechanism (USSR inventor certificate 641973). The mentioned device can be utilized for training volleyball sportsmen when a volleyball ball is used rather than the tennis ball.

However, after a strike, the ball is moving reciprocal-progressively, whereas the hand is moving along an arc, that leads to inconsistency of movement trajectories at the "co-striking". This creates discomfort, can lead to a trauma, and does not allow appropriate improving the strike technique. Following the strike, the ball returns into the initial position only after long chaotic oscillations. Besides, a shortcoming of the device is absence of immediate feedback information about the quality of the strike performed.

DISCLOSURE OF THE SUBSTANCE THE INVENTION

The above-described problem required a solution. The instant invention proposes such solution, which provides the improvement of quality of the player's movements, particularly, operation of the player's hand due to providing the movement of the ball at an arc and a minimal force of the striking movement at a push of the ball from its at-rest state.

The above-stated problem is solved by providing a device for training of striking movements of sportsmen, comprising a bearing frame, a ball, a unit of returning (returning unit) the ball into an initial position including an elastic stretching (or elastic strap) with its first end attached to the frame, wherein, according to the solution, the unit of returning the ball includes a rod, having a first end secured on the frame and capable of providing at least two degrees (directions) of freedom, and a second end coupled with the ball, and the elastic stretching is attached with its second end to the rod. The bearing frame is furnished with a limiter of traveling the rod.

Guides for the elastic stretchings are introduced into the returning unit, which guides can be made as rolls fixed at the perimeter of the bearing frame. The device additionally comprises shock absorbers disposed at the ending points of traveling of the rod. The bearing frame is made in a cramp-like (or C-like profile) shape, and the limiter of traveling is made of trapezium shape, and fixed between the ends of the bearing frame.

The attachment of the ball to the rod is accomplished as two concave discs with slots at the circumference, one of which is disposed inside the ball, and the second disc is disposed outside the ball and secured on the rod parallel to its axis. The attachment of the rod to the frame is designed in the form of a mechanism including a cramp supporting a pin encapsulated in a casing with bushings for fixating the rod and with two insertions of a material having shock-absorbing properties disposed on the opposite ends of the casing.

BRIEF DESCRIPTION OF THE DRAWINGS

A utility sample of the inventive device is explained on the FIGURE attached hereto, representing a general view of the device, wherein 1—rod; 2—axis of fixating the rod; 3—bushings; 4—pin; 5—bearing frame; 6—brackets or attachment elements; 7—guide; 8—elastic stretching; 9—limiter of traveling the rod; 10—shock absorber of the limiter or insertion; 11—ball; 12—elements of touting the stretching; 13—attachment for fixating the ball.

DESCRIPTION OF A PREFERRED EMBODIMENT OF THE INVENTION

While the invention may be susceptible to embodiment in different forms, there is shown in the drawing, and will be described in detail herein, a specific embodiment of the present invention, with the understanding that the present disclosure is to be considered an exemplification of the principles of the invention, and is not intended to limit the invention to that as illustrated and described herein.

The inventive device is arranged according to a pendulum suspension scheme (physical pendulum) that provides a biomechanical consistent interaction of the ball and the hand at the period of "co-striking" owed to the fact that the sportsman's arm may also be considered as a "pendulum suspension". The upper end of the rod 1 is hingedly secured by means of the axis 2 in the bushings 3 of the pin 4, which pin is encapsulated in a casing. The casing of the pin 4 is fixed on the bearing frame 5 by means of a cramp. It has two insertions (shock absorbers) 10 made of material with shock-absorbing properties, for example, rubber, disposed at the opposite ends of the casing. They are intended for damping oscillations (excessive vibrations) after a strike of the rod 1 with the ball 11 against the shock absorbers 10 of the limiter of the rod. The pin 4 is performed with a capability of revolving about its axis and small displacements along the axis due to the insertions 10. Due to such design, the rod acquires an additional degree of freedom along and around the axis of the pin.

The frame 5 can be secured on a pole or a wall by means of the attachment elements 6, for instance, brackets. Where it's secured to the pole, the device can be additionally furnished with a wedge-like support for preventing a spontaneous falling of the bearing frame upon failing the attachment elements.

The returning unit for reverse of the rod with the ball comprises the stretching 8 and the guide therefor. The guide can be made as a system of guiding rolls 7, through which the stretching 8 (rubber shock absorber) is passed. The limiter 9 of traveling the rod is mounted in the lower part of the bearing frame 5, which limiter has a shape of trapezium. The bases of the trapezium restrict oscillations of the rod in the longitudinal direction, and the trapezium sides restrict oscillations in the transversal direction. The limiter is supplied with shock absorbers 10 that may be designed of rubber plates of various lengths; the plates may be folded in halves and arranged in a packet. The edges of the packets—shock absorbers 10 can be secured with cramps that can be attached to the limiters, or can be the bases of the limiters. The lateral sides can also be furnished with shock absorbers. The attachment 13 for fixating the ball may be located on the lower end of the rod. It can be arranged as two concave discs with slots along the circumference for lacing. The ball is attached to the discs via pads and the ball is installed at a distance of 50 mm from the rod. One of the discs is disposed inside the ball, the other one is outside, whereas the plane of the discs is substantially parallel to the axis of the rod. This excludes a hand hit against the rod providing safety of performance of the strike.

Operation of the Inventive Device

Operation of a preferred embodiment of the device is carried out in the following manner:

The device (the upper surface of the ball) is installed on a predetermined height using two capable of dissembling brackets 6, fixed on the bearing frame 5. In the initial position, the pendulum in the form of rod 1 is situated at an angle of 30 degrees to the vertical, and fixed near the front shock absorber by the system of rolls 7 with the stretching 8 (elastic rubber lice-absorber), that corresponds to technological requirements of angular direction of the ball toward the plane of the play ground after the strike action for performance of the spike in volleyball. The aforesaid angle determines the correct operation of the hand. Since, after the spike, the ball is moving at an arc with a radius equal to the length of the rod, the minimal force necessary to apply to the ball for its leaving the state of rest should be exerted along the tangent to the arc. Any other direction of the spike movement of the hand of the striking sportsman will be associated with a greater force, and, in turn, the sportsman will feel it instantly, i.e. he will get information on whether his strike was proper, and will be able to make corrections at the next attempt.

The sportsman chooses a position, corresponding to the phase of the spike, standing while being supported, or jumping without support. He accomplishes a spiking action at the ball with the palm portion of the hand of arm. Having received a significant amount of kinetic energy (pulse of force) and acceleration after the strike, the ball easily overcomes the touting force of the stretching, and displaces along the arc of a radius equal to the length of the rod, encounters the shock absorber of the greater base of the limiter 9. The distance (free traveling of the ball), while the ball passes with a speed from 18 to 20 msec, essentially equals to 930-950 mm if the rod has a length of 800 mm. Having encountered the shock absorber, the ball loses its speed to zero, and, due to the touting force of the stretching, the ball returns to the initial position. During 3-4 reciprocal-progressive swings (in the order of 1.5-2 sec), the ball's inertial energy is depleted, and the ball relaxes in its initial at-rest position, being stopped by the front shock absorber. At this point, the device is ready for operation again.

The device allows: the execution of training common spike movements in volleyball based on the principle of secondary strikes, and, from the very beginning of the training; commencing the development of not only kinematical and rhythmical structures of the striking movement, but, more important, dynamical structures, constituting the basis of the entire striking movement. The device allows getting instant feedback information about the height of takeoff and hand operation.

The invention claimed is:

1. A device for training strike movements of a sportsman, comprising:

a bearing frame;

a ball; and a returning unit for return of the ball into an initial position, including an elastic stretching having one end attached to the frame and another end;

wherein:

the returning unit includes a rod having a first end secured to the frame providing at least two degrees of freedom, and a second end coupled to the ball, wherein the other end of the stretching is attached to the rod.

2. The device according to claim 1, wherein the bearing frame is furnished with a limiter of traveling of the rod.

3. The device according to claim 2, wherein the limiter of traveling of the rod made in a trapezium shape and secured between the ends of the bearing frame.

4. The device according to claim 1, wherein the returning unit further includes guides for the elastic stretching.

5. The device according to claim 4, wherein the guides made as rolls secured to the perimeter of the bearing frame.

6. The device according to claim 1, wherein said device further comprising shock absorbers, disposed at the ending points of traveling of the rod.

7. The device according to claim 1, wherein the bearing frame is made in a cramp-like shape.

8. The device according to claim 1, wherein the attachment of the ball to the rod is accomplished as two concave discs with slots at the circumference, one of said discs is disposed inside the ball, and the second of said discs is disposed outside the ball and secured on the rod parallel to its axis.

9. The device according to claim 1, wherein the attachment of the rod to the frame is performed in the form of mechanism including:

a cramp supporting a pin encapsulated in a casing with bushings for fixating the rod and with two insertions of a material having shock-absorbing properties disposed on the opposite ends of the casing.

* * * * *